United States Patent [19]

Lounsbury

[11] Patent Number: 4,923,080

[45] Date of Patent: May 8, 1990

[54] TRASH RECEPTACLE

[76] Inventor: Donn C. Lounsbury, R.R. 1, Box 24, Wentworth Rd., Walpole, N.H. 03608

[21] Appl. No.: 280,504

[22] Filed: Dec. 6, 1988

[51] Int. Cl.[5] ..... B65F 1/12; B65B 67/00; B65D 43/22; B65D 43/26

[52] U.S. Cl. ..... 220/66; 220/1 T; 220/4 B; 220/324; 220/409; 220/410

[58] Field of Search ..... 220/1 T, 4 B, 4 E, 324, 220/409, 410, 66

[56] References Cited

U.S. PATENT DOCUMENTS

| | | | |
|---|---|---|---|
| D. 258,409 | 3/1981 | Nattrass | 220/4 E |
| 678,404 | 7/1901 | Kline | 220/DIG. 6 |
| 1,157,008 | 10/1915 | Lang | 220/410 |
| 1,213,588 | 1/1917 | Cohan | 220/1 T |
| 2,256,935 | 9/1941 | Austin | 220/324 |
| 2,386,929 | 10/1945 | Brown | 220/409 |
| 3,063,591 | 11/1962 | Laginestra . | |
| 3,195,272 | 7/1965 | Mosher | 220/4 B |
| 3,687,408 | 8/1972 | Lake . | |
| 3,734,340 | 5/1973 | Ippolito | 220/1 T |
| 4,281,813 | 8/1981 | Garrity . | |
| 4,351,539 | 9/1982 | Rodolakis | 220/1 T |
| 4,437,634 | 3/1984 | Hambleton . | |
| 4,457,483 | 7/1984 | Gagne . | |
| 4,576,307 | 3/1986 | Frytenberg | 220/4 E |
| 4,615,464 | 10/1986 | Byrns | 220/4 B |

FOREIGN PATENT DOCUMENTS

| | | | |
|---|---|---|---|
| 2105577 | 3/1983 | United Kingdom | 220/1 T |

*Primary Examiner*—George E. Lowrance
*Attorney, Agent, or Firm*—Jerry T. Kearns

[57] ABSTRACT

A trash receptacle is formed from a hollow body member having a pivotal door formed by a hinged side wall portion. Cooperating latch members retain the door in a closed position. An interior floor within the hollow body member may be horizontal or may be mounted in or movable to an inclined orientation to facilitate removal of a trash bag, without necessitating any vertical lifting. The interior floor may be pivotally mounted within the hollow body and inclined to remove the trash bag by actuation of an exterior foot pedal. The trash receptacle allows filled trash bags to be removed through the side of the receptacle by sliding off the horizontal or inclined floor, obviating the necessity of vertically lifting the filled trash bag, as required by conventional open topped trash receptacles.

1 Claim, 4 Drawing Sheets

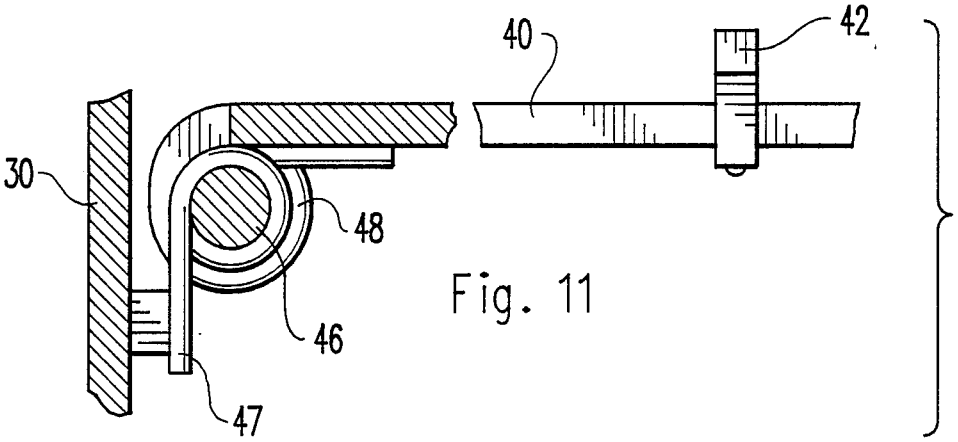
Fig. 11
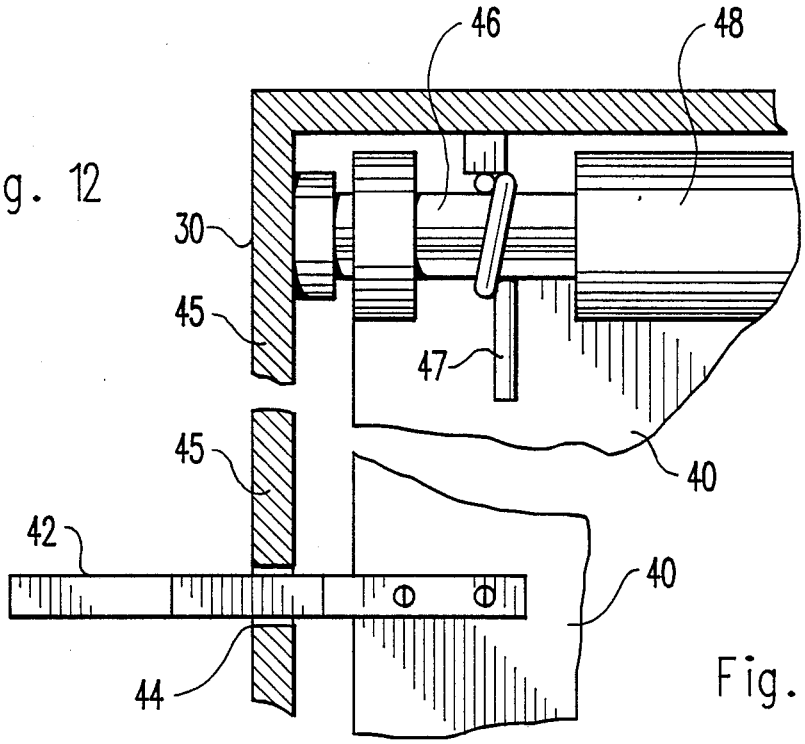
Fig. 12
Fig. 13

TRASH RECEPTACLE

BACKGROUND OF THE INVENTION

1. Field of the Invention

The present invention relates to trash receptacles, and more particularly pertains to a new and improved trash receptacle for allowing removal of filled trash bag liners without requiring any vertical lifting of the filled trash bag. Many individuals are unable to lift even relatively light objects due to age or various medical conditions. The withdrawal of large twenty and thirty gallon sized trash bags from the open top of a conventional trash receptacle is difficult even for an average individual. In order to overcome this problem, the present invention provides a trash receptacle having a pivotal door formed by a side wall portion attached bY a longitudinally extending hinge. A raised interior horizontal or inclined floor allows a filled trash bag to be slid bY dragging out of the trash receptacle, without requiring any vertical lifting. Alternate configurations may utilize widthwise hinges for sidewall attachment.

2. Description of the Prior Art

Various types of trash receptacles are known in the prior art. A typical example of such a trash receptacle is to be found in U.S. Pat. No. 3,063,591, which issued to N. Laginestra on Nov. 13, 1962. This patent discloses a trash receptacle formed from a cYlindrical hollow body member divided into mating halves by a longitudinally extending joint. The halves are connected by a transversely extending hinge along an interior floor portion. Latch members are provided for securing the halves together in a closed position. U.S. Pat. No. 3,687,408, which issued to C. Lake on Aug. 29, 1972, discloses a collapsible support for plastic trash bags. The device includes three rectangular sections adapted to be perpendicularly connected to form an open top and open sided box for supporting the trash bag therein. U.S. Pat. No. 4,281,813, which issued to J. Garrity on Aug. 4, 1981, discloses a trash bag holder formed by an elongated polygonal wire cage having a longitudinally extending seam secured by spring clip members. U.S. Pat. No. 4,437,634, which issued to T. Hambleton on Mar. 20, 1984, discloses a holder for plastic bags which utilizes a rectangular box having open top and front portions. Projections are provided on opposite exterior side wall portions of the box for engagement with handles of the plastic bag. U.S. Pat. No. 4,457,483, which issued to L. Gagne on July 3, 1984, discloses a collapsible support for trash bags which is formed from a one piece blank made of flexible sheet material and having fastening elements holding the sheet material to define an open ended cylinder for receiving and supporting a bag in an upright open mouthed position.

While the above mentioned devices are suited for their intended usage, none of these devices disclose a trash receptacle having a longitudinally extending hinge connecting a side wall portion to a hollow body member and having an inclined interior floor to facilitate removal of filled trash bags without requiring any vertical lifting. Inasmuch as the art is relatively crowded with respect to these various types of trash receptacles, it can be appreciated that there is a continuing need for and interest in improvements to such trash receptacles, and in this respect, the present invention addresses this need and interest.

SUMMARY OF THE INVENTION

In view of the foregoing disadvantages inherent in the known types of trash receptacles now present in the prior art, the present invention provides an improved trash receptacle. As such, the general purpose of the present invention, which will be described subsequently in greater detail, is to provide a new and improved trash receptacle which has all the advantages of the prior art trash receptacles and none of the disadvantages.

To attain this, representative embodiments of the concepts of the present invention are illustrated in the drawings and make use of a hollow body member having a pivotal door formed by a hinged side wall portion. Cooperating latch members retain the door in a closed position. An interior floor within the hollow body member may be horizontal or may be mounted in or movable to an inclined orientation to facilitate removal of a trash bag, without necessitating any vertical lifting. The interior floor may be pivotally mounted within the hollow body and inclined to remove the trash bag by actuation of an exterior foot pedal. The trash receptacle allows filled trash bags to be removed through the side of the receptacle by sliding off the inclined floor, obviating the necessity of vertically lifting the filled trash bag, as required by conventional open topped trash receptacles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readilY be utilized as a basis for the designing of other structures, methods and systems for carrying out the several purposes of the present invention. It is important, therefore, that the claims be regarded as including such equivalent constructions insofar as theY do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash receptacle which has all the advantages of the prior art trash receptacles and none of the disadvantages.

It is another object of the present invention to provide a new and improved trash receptacle which may be easily and efficiently manufactured and marketed.

It is a further object of the present invention to provide a new and improved trash receptacle which is of a durable and reliable construction.

An even further object of the present invention is to provide a new and improved trash receptacle which is susceptible of a low cost of manufacture with regard to both materials and labor, and which accordingly is then susceptible of low prices of sale to the consuming public, thereby making such trash receptacles economically available to the buying public.

Still yet another object of the present invention is to provide a new and improved trash receptacle which provides in the apparatuses and methods of the prior art some of the advantages thereof, while simultaneously overcoming some of the disadvantages normally associated therewith.

Still another object of the present invention is to provide a new and improved trash receptacle which allows trash bags to be removed without any vertical lifting movement.

Yet another object of the present invention is to provide a new and improved trash receptacle formed from a hollow body member with a side wall portion connected by a longitudinally or widthwise extending hinge to form a pivotal door for removal of a filled trash bag.

Even still another object of the present invention is to provide a new and improved trash receptacle which has a hinged side wall portion and an inclined interior floor to facilitate removal of a filled trash bag without requiring any vertical lifting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is an enlarged detail view, partially in cross section, illustrating the pivotal mounting of the interior floor of the trash receptacle of FIG. 10.

FIG. 12 is a detail view, partially in cross section, further illustrating the pivotal mounting of the interior floor of the trash receptacle of FIG. 10.

FIG. 13 is a detail view, partially in cross section, illustrating the foot pedal mechanism for inclining the interior floor of the trash receptacle of FIG. 10.

DESCRIPTION OF THE PREFERRED EMBODIMENT

Figure 1:
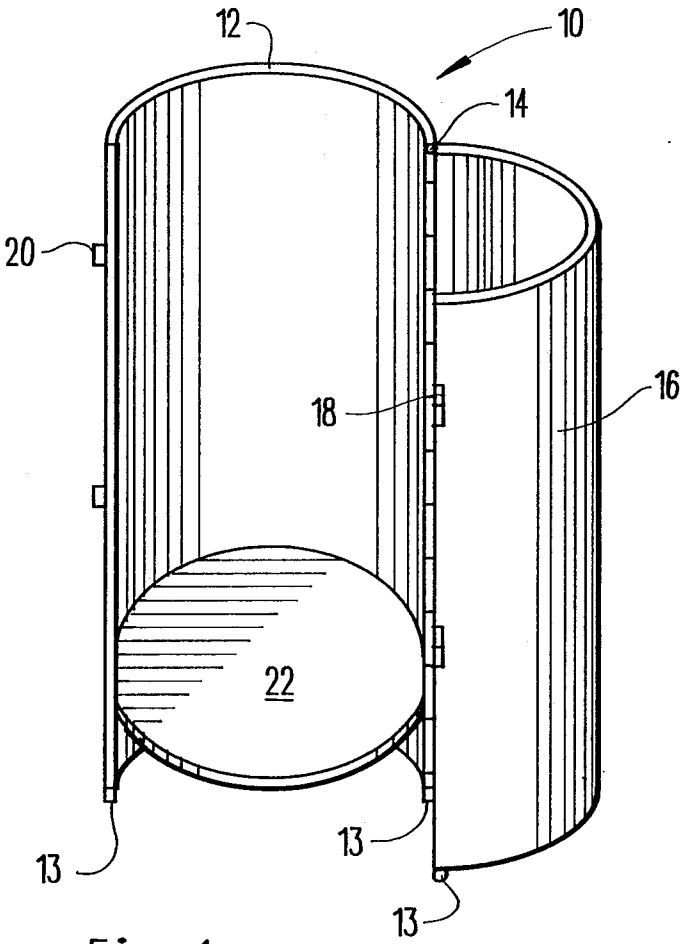
FIG. 1 is a perspective view of the trash receptacle according to the first embodiment of the present invention, with the side wall door in an open position.

With reference now to the drawings, and in particular to FIG. 1 thereof, a new and improved trash receptacle embodying the principles and concepts of the present invention and generally designated by the reference numeral 10 will be described.

More specifically, it will be noted that the first embodiment 10 of the invention includes a generally cylindrical hollow body member 12. It is to be understood that the hollow body member 12 may be of any conventional geometric shape including rectangular, square, hexagonal, octagonal, etc. The hollow body member 12 has a side wall portion 16 connected by a longitudinally extending hinge 14, forming a pivotal door mounted for movement between the illustrated open position and a closed position. It is to be understood that the side wall may be attached with a widthwise extended hinge, either raising or lowering to remove bagged trash. Cooperating latch members 18 and 20 are provided for securing the pivotal door 16 in a closed position. A plurality of castor wheels 13 may be mounted at a lower end of the hollow body member 12 and side wall portion 16. An interior horizontal or inclined floor 22 is raised above the lower end of the body member 12 and is adapted to support the bottom of a conventional plastic trash bag. In use, the door 16 is latched in a closed position, and a plastic trash bag liner is inserted through the open top portion of the hollow body member 12. When the trash bag liner is filled, the neck is tied in a conventional manner and the door 16 is opened. The filled trash bag maY then be dragged off the inclined floor 12, without requiring any vertical lifting movement. The wheels 13 allow the receptacle 10 to be more easily opened, or wheeled to a position adjacent curb side where the filled trash bag is to be deposited awaiting collection.

Figure 2:
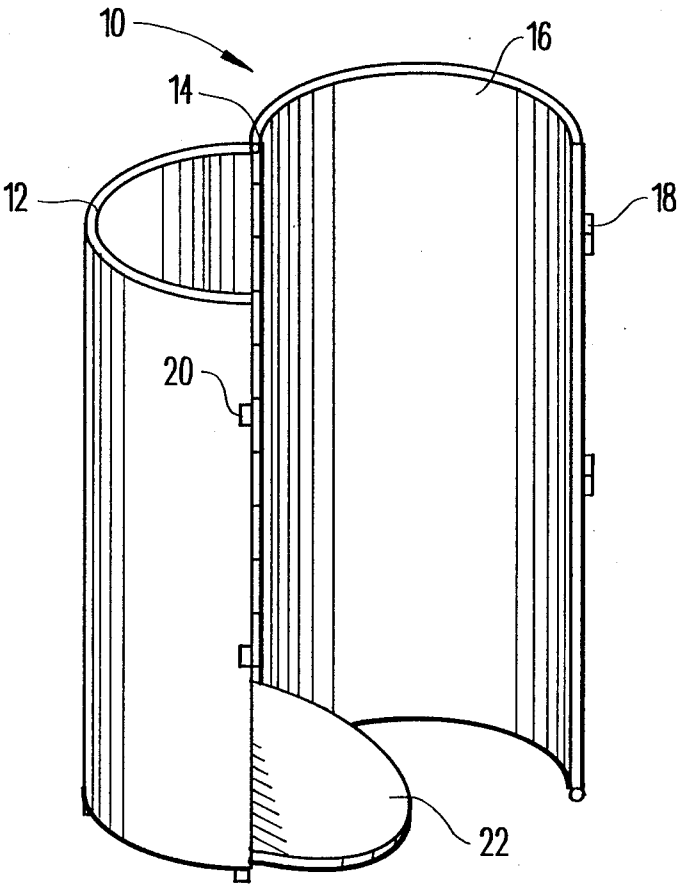
FIG. 2 is a perspective view of the trash receptacle of FIG. 1 illustrated from a side view.

FIG. 2 provides a side perspective view which further illustrates the orientation of the inclined floor 22, with the pivotal door 16 in an open position.

Figure 3:
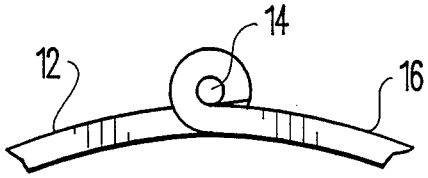
FIG. 3 is a detail view illustrating the hinged connection between the pivotal door and the hollow body of the receptacle.

FIG. 3 provides a top detail view which illustrates the hinged connection between the hollow body member 12 and the pivotal door side wall portion 16. The hinge elements may be integrally molded if the receptacle is formed from a plastic material or formed as bent flange elements if the receptacle is formed from a sheet metal or welded wire mesh material.

Figure 4:
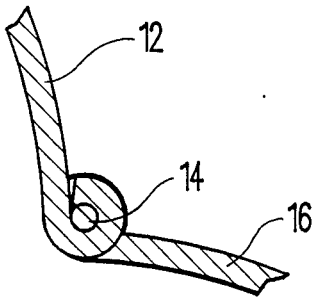
FIG. 4 is a cross sectional view illustrating the hinged connection of FIG. 3.

FIG. 4 provides a cross sectional detail view which further illustrates the construction of the hinge connection between the hollow body member 12 and the pivotal door 16.

Figure 5:
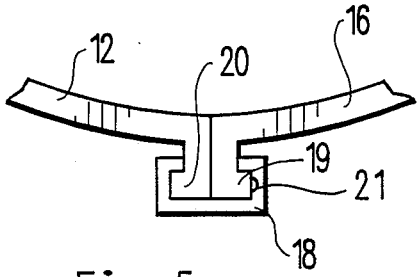
FIG. 5 is a top detail view illustrating the latch mechanism securing the pivotal door in a closed position.

FIG. 5 provides a top detail view which illustrates the construction of the latch mechanism for holding the pivotal door 16 in the illustrated closed position. The vertically aligned L-shaped radially outwardly extending flanges 19 and 20 are provided at the free edges of the body member 12 and door 16. A retaining member 18 has a T-shaped slot which receives the L-shaped flanges and retains them in a closed position. A small projection 21 on the flange 19 prevents the retaining member 18 from being dislodged.

Figure 6:
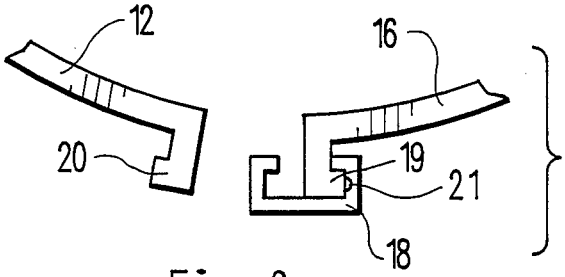
FIG. 6 is a top detail view illustrating the latch mechanism with the pivotal door in an open position.

FIG. 6 provides a top detail view similar to FIG. 5, but with the door 16 in a slightly open position.

Figure 7:
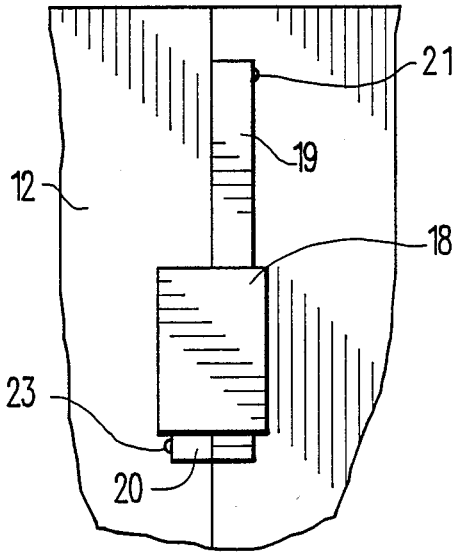
FIG. 7 is a front detail view illustrating the latch mechanism securing the pivotal door in a closed position.

FIG. 7 provides a front detail view which illustrates the retaining member 18 in a closed position on the L-shaped flanges 19 and 20. Protuberances 21 and 23 on the flanges 19 and 20 limit the vertical sliding movement of the retaining member 18 to prevent the loss thereof.

Figure 8:
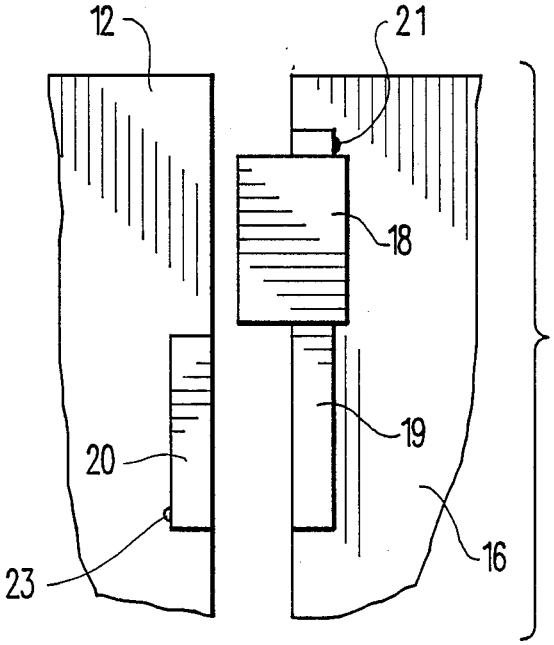
FIG. 8 is a front detail view illustrating the latch mechanism with the pivotal door in an open position.

FIG. 8 illustrates the retaining member 18 slid vertically to release the L-shaped flange 20 from engagement therewith. The L-shaped flange 20 on the body member 12 is substantially shorter than the L-shaped flange 19 on the pivotal door 16. This allows the disengagement of the flange 20, while the retaining member 18 is still engaged with the flange 19.

Figure 9:
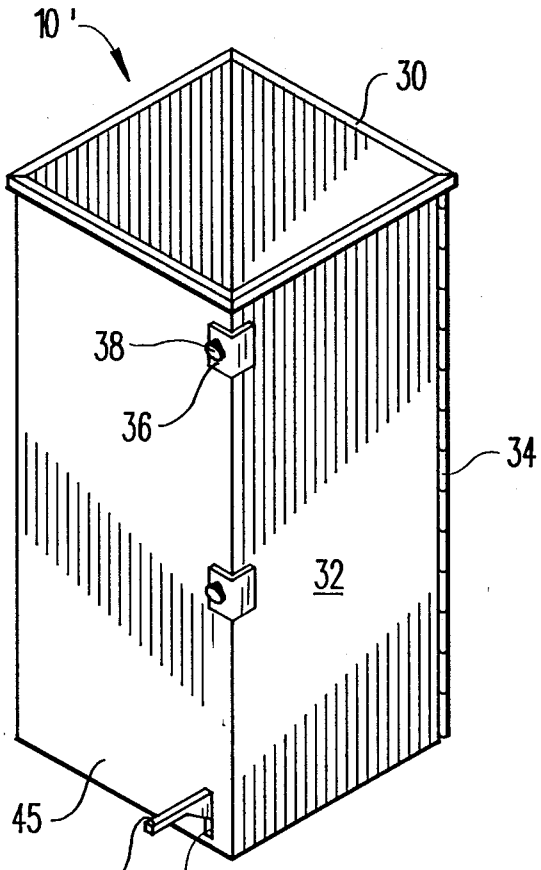
FIG. 9 is a perspective view of the trash receptacle according to the second embodiment of the present invention, with the pivotal door in a closed position.

FIG. 9 illustrates a slightly modified trash receptacle 10' according to a second embodiment of the present invention. The receptacle 10' includes a hollow body member 30 which may be formed of any conventional geometrical shape. A side wall portion 32 of the body member 30 is mounted by a longitudinally extending hinge 34 for pivotal movement the illustrated closed position and an open position. A right angular flange 36 has an oval aperture dimensioned to receive a pivotal oval catch 38. The catch 38 is mounted on the body member 30 and the latch plate 36 is mounted on the pivotal door 32. By rotating the catch member 38, the door 32 may be latched in the illustrated closed position. A foot actuated pedal 42 extends exteriorly of the hollow body member 30 through a vertical slot 44 formed in a side wall 45. The foot pedal 42 is operative to incline a pivotally mounted interior floor portion of the hollow body member 30 to facilitate removal of a trash bag, in a manner to be described subsequently.

Figure 10:
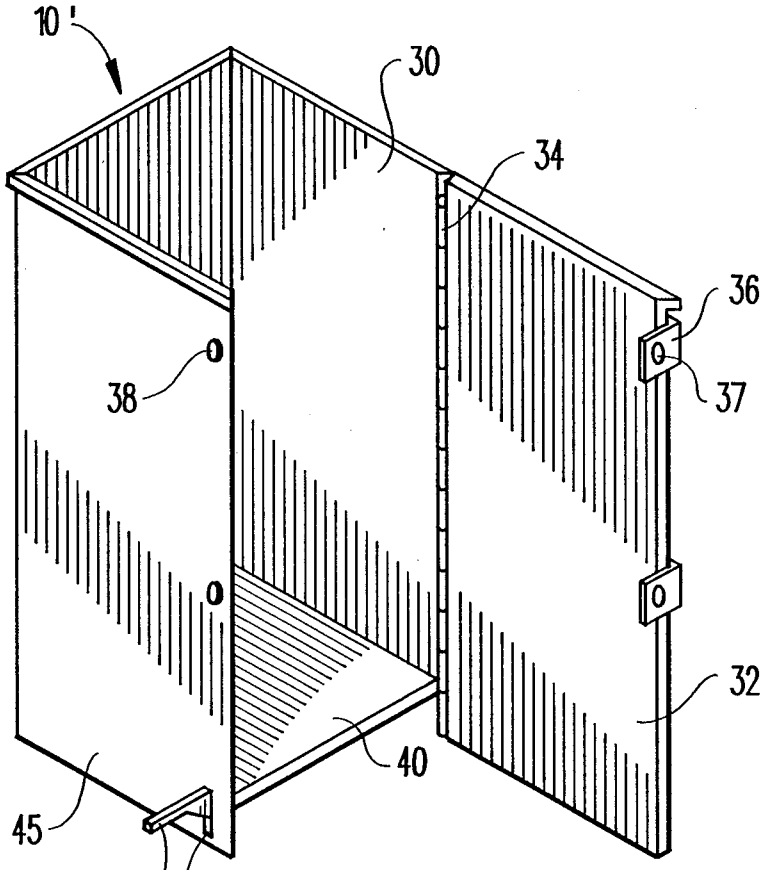
FIG. 10 is a perspective view of the trash receptacle of FIG. 9, with the pivotal door in an open position.

FIG. 10 provides a perspective view of the trash receptacle 10', which illustrates the pivotal door 32 in an open position. The interior floor 40 is mounted for pivotal movement between the illustrated horizontal position and an inclined position upon depressing the foot pedal 42. To remove a filled trash bag, the door 32 is moved to the illustrated open position and the foot pedal 42 is depressed, inclining the interior floor 40 allowing the filled trash bag to be easily slid out of the hollow body member 30, without requiring any vertical lifting. The hollow body member 30 maY be provided with suitable castor wheels or a separate dolly to enable convenient transportation.

FIG. 11 provides a detail side view, partially in cross section, illustrating the interior floor 40 and attached foot pedal 42. The interior floor 40 has a hollow cylindrical journal bearing 48 which is pivotally received on a fixed pivot mounting rod 46. A torsional coil spring 47 biases the interior floor 40 upwardly, where it is retained in a horizontal position by engagement of the foot pedal 42 with the upper end wall of the vertical slot 44 formed in the side wall 45 of the hollow body member 30, as shown in FIG. 10.

FIG. 12 provides a top detail view, partially in cross section, which illustrates the pivotal mounting of the interior floor 40 on the pivot support rod 46. It should be understood that the spring 47 illustrated in FIG. 12 is selected with a spring constant which will support the weight of an average filled trash bag supported on the floor 40, but which may still be easily overcome by an individual depressing the foot pedal 42, to incline the interior floor 40.

FIG. 13 provides a top detail view, partially in cross section, which illustrates the foot pedal 42 attached to the interior floor 40 and extending through the vertical slot 44 formed in the side wall 45 of the hollow body member 30, as also illustrated in FIGS. 9 and 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A trash receptacle adapted for use with disposable trash bags, comprising:

an elongated hollow open top body;

a vertically extending side wall portion of said body mounted by a longitudinal hinge for pivotal movement between open and closed positions;

latch means for securing said side wall portion in said closed position;

an interior floor in said hollow body member, disposed above a lower end of said hollow body;

a pivot mounting rod mounting said floor for limited pivotal movement about an axis transverse to said longitudinal hinge;

a torsional coil spring surrounding said pivot mounting rod and urging said floor to a horizontal position;

and a foot pedal connected to said floor and extending exteriorly of said hollow body, for selectively inclining said floor to facilitate removal of filled trash bags from said trash receptacle, with said side wall portion in said open position.

* * * * *